US008634279B2

(12) United States Patent
Du et al.

(10) Patent No.: US 8,634,279 B2
(45) Date of Patent: Jan. 21, 2014

(54) ALARM CLOCK AND METHOD FOR CONTROLLING A WAKE-UP ALARM

(75) Inventors: Jia Du, Eindhoven (NL); Petronella Hendrika Zwartkruis-Pelgrim, Nuenen (NL); Dzmitry Viktorovich Aliakseyeu, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 46 days.

(21) Appl. No.: 13/393,388

(22) PCT Filed: Aug. 26, 2010

(86) PCT No.: PCT/IB2010/053833

§ 371 (c)(1),
(2), (4) Date: Feb. 29, 2012

(87) PCT Pub. No.: WO2011/027266

PCT Pub. Date: Mar. 10, 2011

(65) Prior Publication Data

US 2012/0163136 A1 Jun. 28, 2012

(30) Foreign Application Priority Data

Sep. 2, 2009 (EP) ..... 09169232

(51) Int. Cl.
*G04C 21/00* (2006.01)

(52) U.S. Cl.
USPC ..... 368/250

(58) Field of Classification Search
USPC ..... 368/10, 250, 72, 223, 262
See application file for complete search history.

(56) References Cited

U.S. PATENT DOCUMENTS

| | | | | |
|---|---|---|---|---|
| 4,702,614 | A | 10/1987 | Copley | |
| 5,846,206 | A | 12/1998 | Bader | |
| 7,306,567 | B2 | 12/2007 | Loree | |
| 7,355,928 | B2 | 4/2008 | Nanda | |
| 7,633,836 | B2 * | 12/2009 | Choi et al. | 368/11 |
| 7,751,284 | B2 * | 7/2010 | Tang | 368/73 |
| 2003/0080872 | A1 | 5/2003 | Gutta | |
| 2003/0142591 | A1 | 7/2003 | Baweja | |
| 2007/0189124 | A1 | 8/2007 | Cuisinier | |

FOREIGN PATENT DOCUMENTS

| | | | |
|---|---|---|---|
| DE | 20302167 | U1 | 7/2004 |
| JP | 2009085901 | A1 | 4/2009 |
| WO | 2008132546 | A1 | 11/2008 |

* cited by examiner

*Primary Examiner* — Edwin A. Leon

(57) ABSTRACT

An alarm clock includes at least one sensor for detecting a body activity level of a human being and is provided to produce a sequence of alarm signals. Each alarm signal within the sequence is suppressible on the detection of a predetermined body activity level. The body activity level required to suppress an alarm signal increases with each subsequent alarm signal within the sequence. The body activity level of a human being is detected during said sequence, and a present alarm signal is suppressed when the body activity level presently detected is greater than the predetermined body activity level required to suppress the present alarm signal.

15 Claims, 2 Drawing Sheets

ALARM CLOCK AND METHOD FOR CONTROLLING A WAKE-UP ALARM

FIELD OF THE INVENTION

The present invention relates to an alarm clock, as well as to a method for controlling a wake-up alarm.

BACKGROUND OF THE INVENTION

Alarm clocks are known to produce wake-up alarm signals at a predetermined time. In most cases the alarm signals are acoustic signals loud enough to be perceived by a sleeping human being. It is noted that other kinds of alarm signals can be used like, for example, optical signals. The intensity of the alarm signal should be high enough to wake up any sleeping person reliably. However, it is also desired to wake up the person gently to avoid a sudden rush from sleep to high body activity, as such a swift change of body functions is often found to be annoying and has proven to be unhealthy. There are several medical reasons to avoid such an extreme change of body activity level. Just to give one example, there is a certain risk of harming the heart functions. Instead it is desired to wake up gradually in a gentle way so that the human body can increase its activity level in smaller steps.

One way to make a person wake up gradually is to produce a sequence of alarm signals of moderate intensity like, for example, acoustic alarm signal which are separated by timeouts. Each alarm signal can be turned off or suppressed. A few minutes after one alarm signal has been turned off, another alarm signal is produced so that the person to be waked up has to make another move to turn off the alarm clock, and the next alarm signal of the sequence will begin after another timeout. This method for controlling a wake-up alarm is known as "snoozing", as it gives the possibility to wake up a person gradually after a number of alarm signals within the sequence. However, experience has shown that in cases when the person is very tired, he or she will hit the "snooze" button to turn off the alarm signal again and again without making any progress to wake up completely. Therefore this well-known "snooze function" does not satisfactorily solve the problem of waking up a person gently and gradually until the person is fully awake.

Another approach to wake up a person is to produce alarm signals which promote a physical effort to turn off the alarm. For example an alarm is produced which can only be turned off by leaving the bed immediately to hit a snooze button which is arranged at a location remote from the bed, or which is provided at an object moving through the bedroom and that has to be caught before it can be turned off. Although alarm clocks of this kind provide a reliable wake-up function, as some physical effort is needed to turn off the alarm, they share the same disadvantage as many other alarm clocks as mentioned above, namely to increase the body activity level not gradually but within a very short time span.

It is therefore an object of the present invention to provide an alarm clock which gradually increases the physical effort needed to turn off the alarm. Another object of the present invention lies in the provision of a corresponding method for controlling a wake-up alarm.

SUMMARY OF THE INVENTION

These objects are achieved by an alarm clock according to the present invention that comprises at least one sensor for detecting a body activity level of a human being. As the alarm clock can produce a sequence of alarm signals, each alarm signal within this sequence is suppressible on the detection of a predetermined body activity level. The body activity level which is required to suppress an alarm signal increases with each subsequent alarm signal within the sequence.

While a minimal physical effort is necessary to suppress, i.e. to "snooze" a first alarm signal, this effort increases with the next alarm signals following within the sequence. The body activity level required to suppress the alarm signal rises until the person is fully awake. Unlike other alarm clocks which need some body activity to turn off the alarm, the alarm clock according to the present invention increases the required body activity level gradually so that the wake-up process is healthier and is not found to be annoying for a person to be waked up.

According to one embodiment of the present invention, the alarm signals within the sequence are separated by timeouts, the duration of each timeout being set according to a detected body activity level.

For example, the timeouts between two alarm signals are shortened when a higher body activity level is detected by the sensor. This function can contribute to shorten the wake-up process, supporting a gradual and gentle wake up at the same time.

According to another embodiment, the sensor is provided to detect at least one of a change of the body position or a body movement.

Preferably the sensor is provided to detect at least one of the duration of a body movement, the intensity of a body movement and the number of body movements.

According to another preferred embodiment of the present invention, the body activity level is derived from differences of the measuring results of different sensors.

The body activity level can preferably be derived from the change rate of the measuring results of at least one sensor within a given time span.

The sensor can preferably be chosen from the following:

An optical sensor, a pressure sensor, an inertia sensor and a distance measuring sensor.

According to another preferred embodiment, the sensor is provided to measure a vital function of the human being.

This vital function can be, for example, the heart rate of the human being, which is directly measured by a corresponding sensor.

The sensor can preferably be integrated in a handheld controller device.

It is noted that the alarm clock according to the present invention is not limited to stand alone alarm clocks like they are known from the state of the art, like, for example, radio alarm clocks to be arranged at the bedside of a person. The alarm clock in the sense of the following description and claims can also be part of a device which comprises other functions. For example, an alarm clock according to the present invention can be a mobile phone or be part of a mobile phone with an alarm function or any other electronic device.

A method for controlling a wake-up alarm according to the present invention comprises the production of a sequence of alarm signals, each alarm signal within that sequence being suppressible on the detection of a predetermined body activity level of a human being, wherein the predetermined body activity level required to suppress an alarm signal increases with each subsequent alarm signal within that sequence, detecting a body activity level of a human being during that sequence and suppressing a present alarm signal when the body activity level presently detected is greater than the predetermined body activity level required to suppress the present alarm signal.

Within this method, the present body activity level measured by a corresponding sensor is compared with the predetermined body activity level presently required to suppress the alarm signal. When the measured present body activity level is greater than the predetermined level, the alarm is suppressed. As the required predetermined body activity level increases with each following alarm signal within the sequence, the physical effort required to suppress the signal also increases, leading to a smooth waking up of the human being.

According to a preferred embodiment of this method, the alarm signals within a sequence are separated by timeouts, the duration of each timeout being set according to a detected body activity level.

Preferably the present body activity level is derived from at least one a measured change of the body position and a measured body movement.

In a preferred embodiment of this method, the present body activity level is derived from at least one of the duration of a body movement, the intensity of a body movement and the number of body movements.

In a preferred embodiment of this method, a body activity level is derived from differences in the measuring results of different sensors.

Preferably the body activity level is derived from a vital function of the human being.

Further aspects and benefits of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The above mentioned features, aspects and advantages of the present invention will become better understood from the following description with reference to the accompanying drawings where.

DETAILED DESCRIPTION OF EMBODIMENTS

Figure 1:
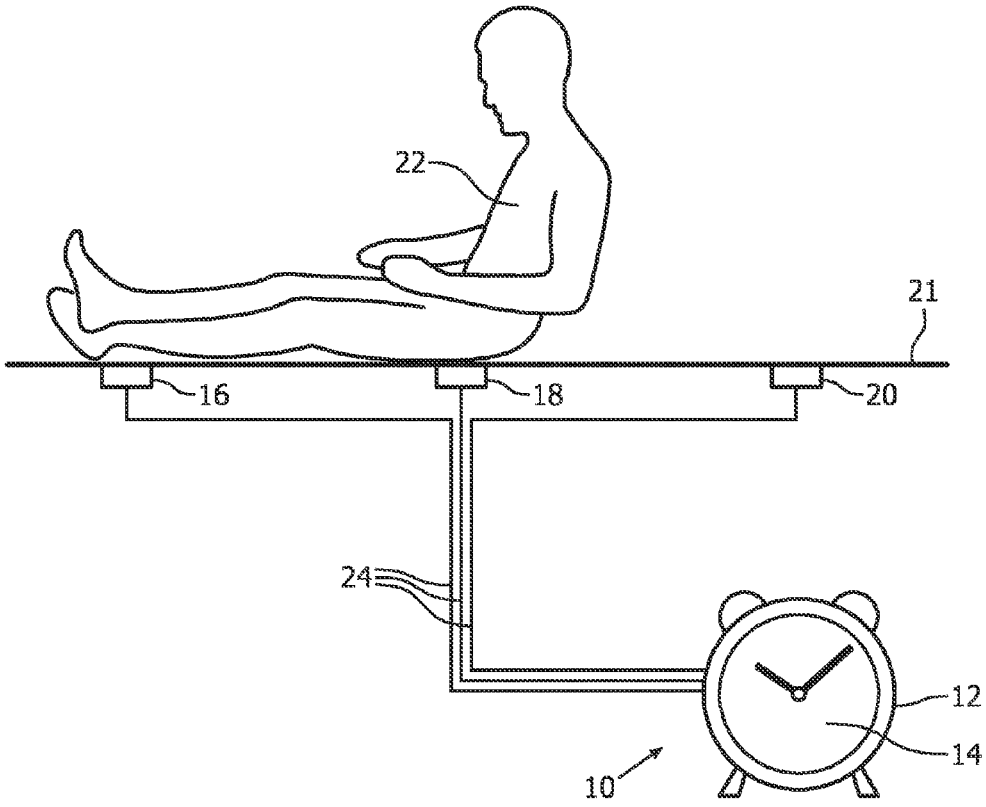
FIG. 1 is a schematic view of a first embodiment of an alarm clock according to the present invention.

The alarm clock 10 in FIG. 1 comprises a housing 12 and a time display 14 at the front side of the housing 12 to display the present time to the user. Inside the housing 12 an electronic circuitry is provided to control the time display 14 and all other functions of the alarm clock 10. On the surface of the housing 12 switching and setting means for the user can be provided to set the alarm clock 10, to switch the alarm on and off, etc.

The alarm clock 10 further comprises pressure sensors 16, 18, 20, integrated in the lying surface 21 of a bed on which the user 22 lies. Each pressure sensor 16, 18, 20 is connected to the circuitry within the housing 12 of the alarm clock 10 by a cable 24. The pressure sensors 16, 18, 20, are provided to measure a respective pressure value, which is transmitted to the circuitry inside the housing 12 via the cable 24.

The sensors 16, 18, 20, which are arranged at different positions within the lying surface 21, form an array to determine the present body position of the user 22. For example, the set of pressure sensors 16, 18, 20 can determine whether the user 22 is still lying on the lying surface 21 of the bed in a flat position or whether he has lifted the upper part of his body up to an upright position. In the first case, all pressure sensors 16, 18, 20, would measure almost the same pressure value. In the second case, which is shown in FIG. 1, the pressure sensor 20 at the head position of the lying surface 21 would measure a zero pressure value, while the other pressure sensors 16, 18 would measure an increased pressure value compared to the first case. This change of pressure values can be detected by the control security within the housing 12 of the alarm clock 10.

The detected change of the body position of the user 22 is interpreted as a certain body activity level, since at least some body activity is necessary to change the body position.

The alarm clock 10 is further provided to produce a sequence of alarm signals. The alarm signals within each sequence are separated by timeouts. Each alarm signal within the sequence is suppressible on the detection of a predetermined body activity level. The body activity level which is required to suppress an alarm signal increases with each subsequent alarm signal within the sequence. For example, the first alarm signal within the sequence which is started at a point of time set by the user can be suppressed on the detection of a first body activity level. When this body activity level is reached by the user 22, the first alarm signal is suppressed. After a time out, a second alarm signal is produced to wake up the user 22. This second alarm signal is suppressible on the detection of a second body activity level allocated to this second alarm signal, but this second body activity level is higher than the first body activity level necessary to suppress the first alarm signal. In practice the user 22 will have to mobilize himself to produce an increasing body activity level, which is necessary to turn off each following alarm signal in the sequence. As a result, he will reach a personal body activity level corresponding to wakefulness.

The production of a sequence of acoustic alarm signals corresponds to the "snooze" function of well-known alarm clocks. However, the alarm signals cannot simply be suppressed by hitting a certain button on the housing 12 but only on the detection of a certain body activity level which is detected by the set of pressure sensors 16, 18, 20. This body activity level rises within the sequence, as it is described above. This avoids the well-known case of hitting the "snooze button" again and again with each alarm signal within the sequence, without making any further progress in waking up, staying on a very low level of body activity and wakefulness. The body activity level of the user 22 is detected at least during the sequence of alarm signals. It is, of course, possible, to monitor the body activity level of the user 22 over a larger time span.

Other sensors can be used to detect a change of the body position of the user 22. For example, a camera can be used to monitor the user 22. The pictures taken by the camera can be interpreted to detect a change of the body position of the user 22.

Instead of detecting the change of the body position, the body activity level of the user 22 can also be derived from the change rate of the measuring result of at least one sensor within a given time span. In the embodiment described in FIG. 1, the pressure change of at least one sensor 16, 18, 20, within a given time span can be measured. If the pressure change $\Delta p$ is bigger than a given threshold $\Delta p_{threshold}$ which is associated to a predetermined body activity level required to suppress a present alarm signal, the alarm signal is suppressed. The actual difference between $\Delta p$ and $\Delta p_{threshold}$ can also be used to set a duration of a time out between consecutive alarms within the alarm sequence. The smaller the difference, the smaller the timeout, and the next alarm will be produced sooner.

Figure 2:
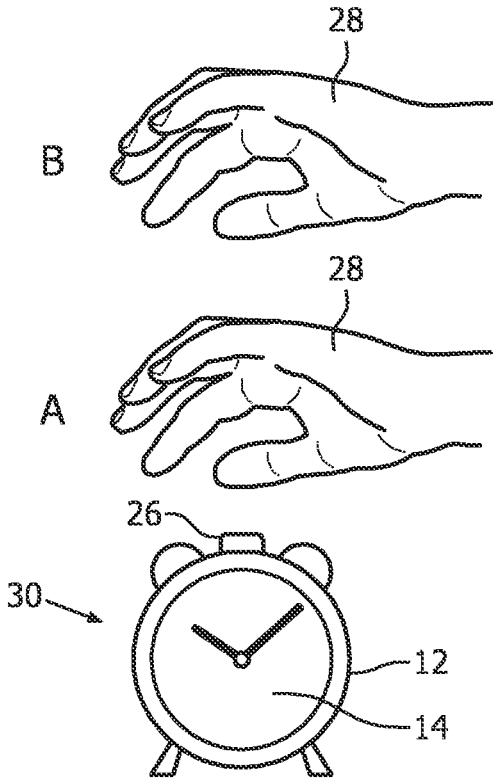
FIG. 2 is a schematic view of a second embodiment of an alarm clock according to the present invention.

In the second embodiment shown in FIG. 2, the alarm clock 30 also comprises a housing 12 and a time display 14, as well as a sensor for detecting a body activity level of the user 22. A difference to the first embodiment shown in FIG. 1 lies in the provision of a distance measuring sensor 26 on top of the housing 12, which replaces the pressure sensors 16, 18, 20 of the alarm clock 10 in FIG. 1. The distance measuring sensor 26, which may be provided as an ultrasonic sensor, measures the distance of a limb, for example, the hand 28 of the user 22 being placed over the top of the alarm clock 10 in a distance. The distance between the hand 28 and the sensor 26 is taken as a degree of the present body activity level of the user 22. With increasing distance between the hand 28 and the sensor 26, the body activity level of the user 22 rises, because a higher body activity level is required to move the hand 28 in distance over the alarm clock 10. The user 22 has to lift this hand 28, and consequently a change of the body position is required.

The alarm clock 30 in the second embodiment in FIG. 2 is provided to produce a sequence of alarm signals, each alarm signal within the sequence being suppressible on the detection of a predetermined body activity level by the sensor 26. For suppressing a first alarm signal within the sequence, it is sufficient to move the hand 28 in a small distance over the sensor 26, as indicated in FIG. 2 by reference A. After the first alarm signal is silent, a second alarm signal follows after a timeout of a few minutes. For suppressing the second alarm signal, it is not sufficient to move the hand 28 in a small distance in position A but to move it in a higher position B, which goes along with a higher level of body activity. When the hand 28 is moved into position B, the second alarm within the sequence is suppressed. For a consecutive third alarm, it will be required to move the hand 28 in an even larger distance over the sensor 26, which is not shown in FIG. 2.

This means that to snooze the alarm, the user 22 will have to move his hand 28 to a high position of increasing height over the sensor 26, going along with an increasing body activity.

Other sensors than the ultrasonic sensor 26 in FIG. 2 can be used in connection with this embodiment. For example, a light sensor can be used to measure the amount of light intensity which can be received by the sensor. The intensity changes with the position of the hand 28 over the sensor 26. In another embodiment, a camera can be used as a sensor 26 to estimate the distance of the hand 28 over the alarm clock 30.

Figure 3:
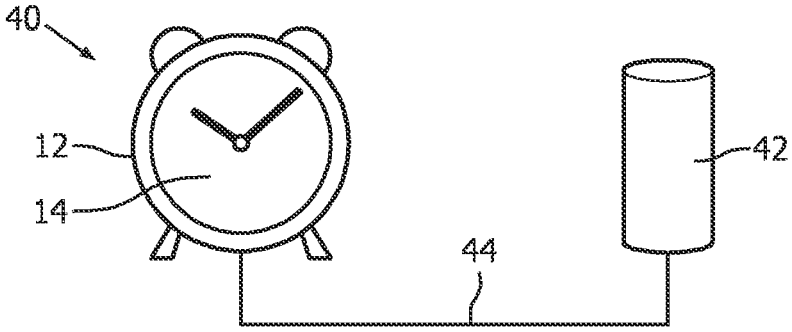
FIG. 3 is a schematic view of a third embodiment of an alarm clock according to the present invention.

In the third embodiment depicted in FIG. 3, the alarm clock 40 comprises a handheld controller device 42 connected with the housing 12 by a cable 44. Inside the handheld controller device 42 there is provided a sensor to measure a movement. For example, the sensor inside the controller 42 can be provided as an inertia sensor, an optical sensor or the like. When the user 22 grabs the handheld controller device 42 with his hand 28 and moves the controller device 42, this movement is detected by the sensor and interpreted as a body activity of the user 22. The sensor is able to measure the amount and/or the duration of a movement. The body activity level derived therefrom can be used to suppress an alarm signal within a sequence of alarm signals produced by the alarm clock 40, as described before in connection with the first and second embodiment. When the measured activity level is sufficient to suppress the present alarm signal, the alarm is silent until the next alarm signal within the sequence, which requires a larger movement of the hand-held controller device 42, a longer duration of the movement and/or a larger amount of a body movement.

Instead of a cable 44, the connection between the handheld controller device 42 and the housing 12 can be established by a wireless communication means to transmit the measured values from the controller device 42 to the housing 12. For example, the controller device 42 can be equipped with a transmitter, while the housing 12 comprises a receiver. In another embodiment the alarm clock 40 can be provided with a function to calibrate the sensor inside the hand-held controller device 42 to personalize the activity level required to suppress each alarm signal within the sequence. The user 22 can then decide on which body activity level the alarm signals within the sequence will be suppressed. These personalized activity levels required to suppress the alarm signals can be stored in a memory device provided inside the housing 12 or in the hand-held controller device 42 of the alarm clock 40.

According to another embodiment, the sensor inside the hand-held controller device 42 of the alarm clock 40 measures a vital function of the human being, like, for example, the heart rate or any other direct indicator of the body activity level. The vital function can be directly measured when the user 22 grabs the hand-held controller device 42 with his hand 28. The measured vital function is allocated directly to a certain body activity level. The alarm clock 40 can the decide whether the present body activity level of the user is sufficient to suppress a present alarm signal within a sequence of alarm signals produced by the alarm clock.

The hand-held controller 42 can also be used in connection with any device having an alarm clock function to produce a sequence of alarm signals. For example, the controller device 42 can be combined with a mobile phone having an alarm clock function. In this case the mobile phone and the hand-held controller device 42 form the alarm clock system according to the present invention.

It is further possible to integrate parts of the alarm clock according to the present invention into parts of the bed wherein the user 22 is sleeping. For example, the sensor for detecting the body activity level of the human beings 16 can be integrated into the blanket of the bed while other parts of the alarm clock are integrated into other parts of the bed.

The above description is intended to be merely illustrative to the present invention and should not be construed as limiting the attended claims to any particular embodiment or a group of embodiments. While the invention has been described in detail with reference to specific exemplary embodiments thereof, different modifications and changes can be made thereto without departing from the spirit and the scope of the invention as set forth in the claims. This specification and drawings are accordingly to be regarded to be in an illustrative manner and are not intended to limit the scope of the claims. In the claims the word "comprising" does not exclude other elements or steps, and the indefinite article "a" or "an" does not exclude a plurality. Any reference signs in the claims should not be construed as limiting the scope.

The invention claimed is:

1. Alarm clock comprising:

at least one sensor configured to detect activity level of person, the activity level being selectable from a plurality of predetermined activity levels having values from least to most active; and an alarm configured to produce a plurality of alarm signals, each alarm signal being suppressible by detection by the at least one sensor of a predetermined activity level, wherein the predetermined activity level required to suppress an alarm signal increases with each subsequent alarm signal.

2. The alarm clock according to claim 1, wherein the plurality of alarm signals are separated by timeouts, the duration of each timeout being set according to a value of the detected activity level.

3. The alarm clock according to claim 1, wherein the activity level is at least one of a change of a position and a movement of the person.

4. The alarm clock according to claim 3, wherein said at least one sensor detects at least one of a duration of the movement, an intensity of the movement and a number of movements of the person.

5. The alarm clock according to claim 1, wherein the at least one sensor comprises a plurality of sensors and the activity level is derived from differences of detection results of different sensor.

6. The alarm clock according to claim 1, wherein the activity level is derived from a change rate of detection results of at least one sensor within a given time span.

7. The alarm clock according to claim 1, wherein said at least ones sensor is selected from at least one of an optical sensor, pressure sensor, a inertia sensor, and a distance measuring sensor.

8. The alarm clock according to claim 1, wherein said at least one sensor detects a vital function of the person.

9. The alarm clock according claim 1, wherein said at least one sensor is integrated in a hand-held controller device.

10. A method for controlling a wake-up alarm, the method comprising acts of:

detecting activity level of a person, the activity level being selectable from a plurality of predetermine activity levels having values from least to most active;

producing a plurality of alarm signals, each alarm signal being suppressible by detection of a predetermined activity level, wherein the predetermined activity level required to suppress an alarm signal increases with each subsequent alarm signal; and suppressing a first alarm signal when the detected activity level is greater than the predetermined activity level required to suppress the first alarm signal.

11. The method according to claim 10, wherein the plurality of alarm signals are separated by timeouts, the duration of each timeout being set according to a value of the detected activity level.

12. The method according to claim 10, wherein the first activity level is derived from at least one of a change of a position and a measured body movement of the person.

13. The method according to claim 10, wherein the first activity level is derived from at least one of a duration movement, an intensity of movement and a number of movements of the person.

14. The method according to claim 10, wherein the activity level is derived from differences detected by one or more different sensors.

15. The method according to claim 10, wherein the activity level is derived from a detection of a vital function of the person.

* * * * *